United States Patent [19]

Smith et al.

[11] Patent Number: 4,673,523

[45] Date of Patent: Jun. 16, 1987

[54] GLASS CLEANING COMPOSITION CONTAINING A CYCLIC ANHYDRIDE AND A POLY(ACRYLAMIDOMETHYLPROPANE) SULFONIC ACID TO REDUCE FRICTION

[75] Inventors: James A. Smith, Chatham, Mass.; George W. Kellett, Cranford, N.J.

[73] Assignee: Creative Products Resource Associates, Ltd., Clifton, N.J.

[21] Appl. No.: 852,540

[22] Filed: Apr. 16, 1986

[51] Int. Cl.[4] ..... C11D 3/20; C11D 3/30; C11D 3/37; C11D 17/04

[52] U.S. Cl. ..... 252/91; 15/104.93; 15/220 R; 252/89.1; 252/153; 252/162; 252/170; 252/173; 252/174.19; 252/174.23; 252/174.24; 252/541; 252/542; 252/545; 252/548; 252/551; 252/DIG. 10; 252/DIG. 14

[58] Field of Search ..... 252/89.1, 91, 153, 162, 252/170, 171, 173, 174.19, 174.23, 174.24, 541, 542, 545, 548, 551, DIG. 10; 15/104.93, 220 R

[56] References Cited

U.S. PATENT DOCUMENTS

| | | | |
|---|---|---|---|
| 3,275,561 | 9/1966 | Pye | 252/110 |
| 3,342,740 | 9/1967 | Kasmierczak | 252/153 |
| 3,449,255 | 6/1910 | Johnston | 252/117 |
| 3,696,043 | 10/1972 | Labarge et al. | 252/153 |
| 3,939,090 | 2/1976 | Zmoda | 252/90 |
| 3,989,633 | 11/1976 | Frisque | 252/11 |
| 4,065,422 | 12/1977 | Lundmark | 524/394 |
| 4,083,794 | 4/1978 | Lee et al. | 252/99 |
| 4,343,725 | 8/1982 | Kiewert et al. | 252/542 |
| 4,448,704 | 5/1984 | Barby et al. | 252/91 |
| 4,448,705 | 5/1984 | Gray | 252/102 |
| 4,508,635 | 4/1985 | Clarke | 252/174.23 |
| 4,528,039 | 7/1985 | Rubin | 134/2 |
| 4,539,145 | 9/1985 | Alvarez et al. | 252/542 |
| 4,540,510 | 9/1985 | Karl | 252/315.3 |
| 4,554,099 | 11/1985 | Clarke | 252/551 |

*Primary Examiner*—Dennis L. Albrecht
*Attorney, Agent, or Firm*—Merchant, Gould, Smith, Edell, Welter & Schmidt

[57] ABSTRACT

A cleaning solution comprising a water-alcohol mixture, an anionic surfactant, a glycol ether, an anionic polysulfonic acid and an anhydride compound comprising an olefin-maleic anhydride copolymer, a monomeric cyclic anhydride or mixtures thereof, is disclosed which is employed to impregnate absorbent substrates to prepare applicators useful for cleaning glass surfaces.

20 Claims, No Drawings

GLASS CLEANING COMPOSITION CONTAINING A CYCLIC ANHYDRIDE AND A POLY(ACRYLAMIDOMETHYLPROPANE) SULFONIC ACID TO REDUCE FRICTION

FIELD OF THE INVENTION

The present invention relates to an aqueous solution effective for cleaning glass surfaces and to porous applicators impregnated with the cleaning solutions.

BACKGROUND OF THE INVENTION

A number of liquid compositions have been disclosed which are intended to clean glass surfaces, such as mirrors, window panes, automobile windshields, lenses, table tops and the like. These compositions are typically formulated as aqueous solutions of surfactants which can contain varying amounts of solvents such as alcohols and glycol ethers. The compositions are often adapted to be sprayed onto a soiled glass surface, and the excess is then manually removed along with the soil by wiping with an absorbent cloth or towel.

Attempts to improve the performance of liquid glass cleaning compositions have led to the incorporation of water-dispersible or water-soluble polymeric materials therein. These compositions are intended to reduce streaking and promote uniform drying by depositing a thin polymeric film on the cleaned glass. For example, U.S. Pat. Nos. 4,539,145; 4,343,725; and 3,939,090 disclose the use of aqueous glass cleaners which incorporate polyoxyethylene glycols, polyvinyl alcohols and olefin-maleic anhydride copolymers, respectively. However, the use of such film-forming polymers can unduly increase the friction between the applicator sheet and the glass, thus increasing the work required to accomplish the cleaning task. Furthermore, the use of certain polymers can lead to the excessive accumulation of light-distorting, cloudy or dust-collecting films.

Absorbent sheet materials which are pre-impregnated with liquid cleaning compositions and which are intended to be applied directly to the glass surface have been disclosed. For example, see Barby et al., (U.S. Pat. No. 4,448,704), which discloses an aqueous composition including a nonionic surfactant and a neutralized, partially-esterified resin copolymer. However, compositions formulated to be effective as two-step glass cleaning and compositions designed to accomplish the cleaning and drying steps in one operation are generally not interchangeable. Attempts to clean and dry glass in a single operation can often result in a glass surface which is streaky or cloudy due to the non-uniform application of the composition and the uneven drying of the film which remains on the glass.

Thus, a need exists for a liquid glass cleaning composition which can be readily applied to and removed from a soiled glass surface to leave the surface clean and free of streaking and cloudiness. A further need exists for a liquid glass cleaning composition which is effective to clean and dry soiled glass without streaking in a single operation.

BRIEF DESCRIPTION OF THE INVENTION

The present invention is directed to an aqueous glass cleaning solution which incorporates a combination of a polysulfonic acid and an anhydride compound which cooperate to facilitate the application of the composition to the glass and the deposition of a clear, coherent polymeric film thereon. Thus, when an absorbent sheet is moistened with the present cleaning solution and wiped over a soiled glass surface, the blend of active ingredients increases the ease of the application process by reducing the coefficient of friction between the applicator material and the glass. The cleaning solution then dries uniformly to leave a clear, even film on the glass. The film is coherent, or "streak-free" and is recoatable in that it is renewed when the glass is subsequently cleaned with the cleaning solution.

The glass cleaning solution will also contain ingredients which act to dissolve and disperse dirt and grease. These ingredients include one or more anionic surfactants, alcohols and glycol ethers. Preferably, the present solutions will also contain a plasticizer to enhance the properties of the polymeric film and will be adjusted to an alkaline pH.

The present invention is also directed to an applicator for cleaning glass surfaces which comprises a porous substrate such as a paper sheet which is impregnated with an effective amount of the present cleaning solution. Such a pre-moistened applicator is highly effective as a "one-step" glass cleaner. When applied to a soiled glass surface under conditions of pressure, the applicator releases an amount of the cleaning solution effective to disperse or dissolve the soil. The loosened soil is bound by the substrate matrix and a thin film of the cleaning solution is deposited on the glass. The liquid film readily dries to a clear, coherent, uniform polymeric film. Thus, the applicators of the present invention both clean and leave the glass surface in a dry, streak-free condition without the need for a further wiping or polishing operation. Although the present applicators are impregnated with solutions which can contain substantial amounts of volatile solvents which tend to evaporate upon exposure to ambient conditions, they retain a high degree of "slip" on the glass for prolonged periods of time.

DETAILED DESCRIPTION OF THE INVENTION

The glass cleaning composition of the present invention is a solution which comprises a major proportion of a water-alcohol mixture, an anionic surfactant, a glycol ether and a mixture of: (a) an anhydride compound comprising low molecular weight, monomeric cyclic anhydride, a copolymer derived from a substituted or unsubstituted maleic anhydride and a lower olefin or mixtures thereof, and (b) a poly(acrylamidomethylpropane) sulfonic acid (the "polysulfonic acid"). Optional ingredients include a plasticizer and an amount of a basic compound effective to alkalinize the solution.

The Cyclic Anhydride

The anhydride component of the present cleaning solution can comprise a low molecular weight, monomeric cyclic anhydride. Preferred cyclic anhydrides will exhibit a molecular weight of about 100–500, most preferably about 100–300. Useful anhydride compounds of this class include aromatic or alkyl anhydrides such as succinic anhydride, glutaric anhydride, trimellitic anhydride, phthalic anhydride and mixtures thereof. These anhydrides are commercially available, for example, from the Aldrich Chemical Co., Milwaukee, Wis.

It was surprisingly found that the introduction of these cyclic anhydrides into the present cleaning solution in combination with the polysulfonic acid component greatly reduces the coefficient of friction (the "slip resistance") between the cleaning substrate sheet which is used to apply the composition to the glass. This reduction in slip resistance allows the user to clean glass quickly and with a minimal expenditure of effort, even when the substrate sheet has become substantially dry, due to the depletion of the cleaning solution from the sheet.

The Olefin-Maleic Anhydride Copolymer

The cleaning solution of the present invention can comprise a copolymer derived from a substituted or unsubstituted maleic anhydride and a lower olefin in place of all or a portion of the cyclic anhydride. The copolymer contributes to the ability of the present cleaning solution to dry to a clear, streak-free film. Preferably, the maleic anhydride monomer is of the formula:

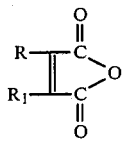

wherein R and $R_1$ are independently H, $(C_1-C_4)$alkyl, phenyl, $(C_1-C_4)$alkylphenyl or phenyl$(C_1-C_4)$alkylene; most preferably R and $R_1$ are H. The lower olefin component is preferably a $(C_2-C_4)$olefin, e.g., ethylene, propylene, butylene, isobutylene or isopropylene; and most preferably is ethylene. The preferred ethylene-maleic anhydride copolymers and the preparation thereof are disclosed in U.S. Pat. No. 3,939,090, the disclosure of which is incorporated by reference herein. These polymers are commercially available in a variety of molecular weight ranges, for example, as EMA-21, EMA-31, EMA-91 and EMA-1103 (Monsanto Co., St. Louis, Mo.). The copolymers may vary in molecular weight, e.g., from about 300-500 to $-2\times10^6$ or more. Preferred copolymers are those having a molecular weight, of about 500,000-1,000,000, since they are more effective in eliminating streaking of the polymeric film. For example, EMA-31 has a molecular weight of about 800,000.

Although either the monomeric cyclic anhydride or the maleic anhydride-olefin copolymer can be employed as the sole anhydride compound in the present solutions, it is preferred to employ them in combination. When used in combination, a synergistic effect is observed in the reduction of the slip resistance of the impregnated substrate employed to apply the solution to the glass. In preferred embodiments of the present cleaning solutions, about 0.03-0.25% of the copolymer is combined with about 0.005-1.0% of the monomeric anhydride. Most preferably, the weight ratio of monomeric anhydride to copolymer is about 2-3:1.

Basic Compound

The present cleaning solutions will also comprise an amount of a basic compound which is effective to solubilize the anhydride compound in the aqueous-alcoholic medium. Most preferably, the copolymer and/or the monomeric anhydride will be introduced into the present cleaning solution in an aqueous solution which comprises an amount of a basic compound effective to presolubilize the copolymer or the anhydride. It is also preferred to adjust the final pH of the cleaning solution to a basic pH, in order to enhance the ability of the solution to subsequently resolubilize the residual polymeric film on the cleaned glass.

Useful basic compounds include ammonia and basic organic compounds, such as amines, e.g., monoalkylamines, dialkylamines and trialkylamines with 1 to 4 carbon atoms in the alkyl radical, the corresponding mono-, di-, or trialkanolamines with 2 to 4 carbon atoms in each alkylol; cycloalkylamines, like cyclohexylamine and heterocyclic amines like morpholine, piperidine, and the like. It is believed that ammonia solubilizes the anhydride compound by opening the anhydride ring to yield carboxamide and ammonium carboxylate groups: $RCO—O—CO—R \rightarrow RCONH_2 + RCO_2^- NH_4^+$.

The Polysulfonic Acid

The cleaning solutions of the present invention will comprise an amount of an anionic polysulfonic acid: poly(2-acrylamido-2-methylpropane)sulfonic acid which incorporates repeating units of the general formula: $[—CH_2CH(CONHCMe_2CH_2SO_3^- H^+)—]$.

This polymer is commercially available as HSP-1180 from the Henkel Corp., Hoboken, N.J., which is a 14-17% aqueous solution of the polysulfonic acid (pH 0.5-1.0; $2\times10^5$ cps viscosity, molecular weight $=1-2\times10^6$).

When the polysulfonic acid component is combined with the anhydride compound in the present cleaning solutions, a cooperative interaction results which substantially retards the drying time of the solutions, but which nonetheless leads to an extremely clear and streak-free film, an effect which is believed to be due to increased uniformity in the drying of the liquid film. The polysulfonic acidanhydride blend is also highly effective in suspending the soil, which increases the ability of the solution-impregnated applicators to absorb the loosened soil. These important effects are further surprising in view of the small amount of these active ingredients which is included in the present solution, preferably no more than about 0.75-1.0% by weight of the cleaning solution. Preferably, the weight ratio of the polysulfonic acid to the copolymer will be about 1.25-0.75:1.

The present solutions can also contain a minor but effective amount of a plasticizer to improve the stability and other physical properties of the residual polymeric film. The plasticizer also improves the recoatability of the polymer film, e.g., the resolubilization on the old film and its replacement with a new one. Useful plasticizers include about 0.05-1.0% of a glycols such as propylene glycol and ethylene glycol, and also include N-methyl-2-pyrrolidone (M-pyrol).

Surfactant

The cleaning solutions of the present invention will also comprise an amount of an anionic surfactant which is effective as a soil-dispersant while not interfering with the clarity of the residual polymeric film. Nonionic detergents have not been found to be satisfactory in this respect. Preferred anionic surfactants include the sulfate or sulfonate surfactants, including mixtures thereof.

Useful anionic surfactants of this class include the salts of fatty alcohol polyethylenoxy sulfate salts, such as the sodium or ammonium sulfates of the condensation products of about 1-7 moles of ethylene oxide with a $C_9-C_{22}$-n-alkanol. Commercially available surfactants of this type include those of the formula, $CH_3(CH_2)_nCH(OCH_2CH_2)_mOSO_3M$ wherein $n=10-13$, $m=1-4$ and M is sodium or ammonium, e.g., sodium laureth sulfate or ammonium laureth sulfate (n=10, m=1–4) which are available as Steol ® CS-460 or CA-460, respectively, (Stephan Chem. Co., Northfield, Ill.) and Neodol ® 25-3A or 25-3S (n=10–13, m=1–4, M=ammonium or sodium, respectively; Shell Chemical Co., Houston, Tex.). Another useful class of anionic surfactants encompasses the watersoluble sulfated and sulfonated anionic alkali metal and alkaline earth metal detergent salts containing a hydrophobic higher alkyl moiety (typically containing from about 8 to 22 carbon atoms), such as salts of alkyl mono or poly-nuclear aryl sulfonates having from about 1 to 16 carbon atoms in the alkyl group (e.g., sodium dodecylbenzenesulfonate, magnesium tridecylbenzenesulfonate, lithium or potassium pentapropylenebenzenesulfonate, sodium xylene sulfonate, sodium naphthalene sulfonate, sodium toluene sulfonate and mixtures thereof). Compositions comprising sodium dodecylbenzene sulfonate are available as the Bio-Soft ® series, i.e. Bio-Soft ® D-40 (Stepan Chemical Co., Northfield, Ill.).

Other useful classes of anionic surfactants include the alkali metal salts of sulfosuccinic acid esters, e.g., dioctyl sodium sulfosuccinate (Monawet ® series, Mona Industries, Inc., Paterson, N.J.); the alkali metal salts of alkyl naphthalene sulfonic acids (methyl naphthalene sodium sulfonate, Petro ® AA or Petro ® 22, Petrochemical Corporation); sulfated higher fatty acid monoglycerides such as the sodium salt of the sulfated monoglyceride of coconut oil fatty acids and the potassium salt of the sulfated monoglyceride of tallow fatty acids; alkali metal salts of sulfated fatty alcohols containing from about 10 to 18 atoms (e.g., sodium lauryl sulfate and sodium stearyl sulfate); sodium $C_{14}$–$C_{16}$-alpha-olefin sulfonates such as the Bio-Terge ® series (Stepan Chemical Co.); alkali metal salts of higher fatty esters of low molecular weight alkylol sulfonic acids, e.g., fatty acid esters of the sodium salt of isethionic acid; the fatty acid amides of amino alkyl sulfonic acids, e.g., lauric acid amide of taurine; as well as numerous other anionic organic surface active agents.

A further useful class of anionic surfactants includes the 8-(4-n-alkyl-2-cyclohexenyl)-octanoic acids wherein the cyclohexenyl ring is substituted with an additional carboxylic acid group. These compounds, or their potassium salts, are commercially available from Westvaco Corporation as Diacid ® 1550 or H-240.

In general, these organic surface active agents are employed in the form of their alkali metal salts, ammonium or alkaline earth metal salts as these salts possess the requisite stability, solubility, and low cost which is desirable to practical utility.

Glycol Ether

The present cleaning solutions will also comprise an amount of a ($C_1$–$C_4$)alkylene($C_1$–$C_4$)alkyl ether or a ($C_1$–$C_4$) dialkylene($C_1$–$C_4$)alkyl ether effective to solubilize oily or greasy soils. The glycol ethers also act as leveling agents for the residual polymeric film. Specific compounds of this class include members of the Arcosolv ® series (Arco Chemical Co., Philadelphia, Pa.) such as Arcosolv ® PM (propylene glycol monomethyl ether) and Arcosolv ® DPM (dipropylene glycol methyl ether). Other lower(alkyl)glycol ethers include ethylene glycol monomethyl ether, ethylene glycol ethyl ether, ethylene glycol butyl ether (2-butoxyethanol), 2-(2-butoxy-ethoxy)-ethanol (Butyl Carbitol ®), diethylene glycol monomethyl ether, and 1-methoxy-2-propanol.

Alcohol

The present cleaning solutions will comprise a major proportion of aqueous alcohol. The alcohol functions as a cleaning agent and its evaporation aids in drying the residual polymeric film. Therefore, $C_1$–$C_4$ alkanols are preferred for use in the present solutions, e.g., methanol, ethanol, propanol, isopropanol, butanol and mixtures thereof. The incorporation of about 10–35% by weight of an alcohol such as isopropanol in the present solutions has been found to yield satisfactory drying performance over the range of expected end use temperatures (4°–50° C.).

Therefore, the preferred glass cleaning solutions will comprise by weight, an anhydride compound comprising (i) about 0.005–1%, most preferably about 0.1–0.75% of the low molecular weight monomeric cyclic anhydride; (ii) about 0.03–0.25%, most preferably about 0.05–0.175% of the ($C_2$–$C_4$)olefin-maleic anhydride copolymer, or (iii) mixtures thereof; about 0.025–0.5%, most preferably about 0.04–0.25% of poly-(2-acrylamido-2-methylpropane) sulfonic acid; an amount of ammonia effective to solubilize the anhydride compound; about 0.01–0.3% of an anionic sulfonate or sulfate surfactant; about 0.05–1.0% of a ($C_1$–$C_4$-)alkylene glycol ($C_1$–$C_4$)alkyl ether or of a ($C_1$–$C_4$-)dialkylene glycol ($C_1$–$C_4$)alkyl ether; about 5–25% of a $C_1$–$C_4$ alkanol, the balance water, wherein the pH of the solution is adjusted to about 7.5–10, preferably to about 8–9.5. This can be accomplished by the addition of about 0.05–0.75% of an alkanol amine such as triethanol amine.

The glass cleaning solutions are preferably prepared by pre-forming an aqueous solution of the anhydride compound in water by mixing the anhydride compound with a molar excess of a basic compound such as an amine or ammonia. The cyclic anhydride solution can be incorporated into the finished glass cleaner solution to the extent of about 0.05–10% by weight of the final solution, and can contain about 5–15% of the solubilized anhydride, e.g., phthalic anhydride. The copolymer solution can be incorporated into the finished glass cleaner solution to the extent of about 10–35% by weight of the final solution, and can contain about 0.25–1.0% of a solubilized copolymer such as EMA-31.

The copolymer solutions then can be simply added to the balance of the water at 25° C., with agitation, followed by the sequential addition of the polysulfonic acid, the alkanol co-solvent, the surfactant, the glycol ether, and the plasticizer, if any. An additional amount of a basic compound is added, as needed, to bring the pH into the desired range. Stirring is continued until a clear solution is obtained. The finished solutions are highly effective to clean glass, although they comprise very low levels of solid "actives", preferably no more than about 1–1.5% by weight.

Although the present glass cleaning solution can be applied to soiled glass surfaces by conventional means, as by spraying it onto the glass manually or via pressurized aerosol vessels, it is highly preferred to employ the cleaning solution to impregnate a suitable porous moisture-absorbent substrate, such as an absorbent sheet of paper, textile or foam. Suitable substrates can be selected from materials which can hold and dispense an effective cleaning amount of the solution, while absorbing the dirt during the cleaning step. Cellulosic sheets have been found to be particularly well suited for use as substrates for the present applicators, and are preferably either reinforced or unreinforced, one or multi-ply nonwoven paper sheets. The cleaning solution can be applied to the substrate to the desired load by processes such as dipping, spraying and the like.

Since the present cleaning solutions are relatively volatile under ambient conditions, the loaded applicators will be packaged and stored in moisture-resistant containers such as those formed of metal foil, metalized paper, moisture-impermeable plastics, or composites thereof. The applicators can be packaged individually or a plurality of sheets can be folded together or formed into a separable roll within a single container. Suitable packaging for premoisturized towelette products is known in the art. For example, see U.S. Pat. Nos. 4,017,002; 3,057,467; and 4,219,129, the disclosures of which are incorporated by reference herein. The resultant pre-moistened applicator can then be employed as a one-step glass cleaner. When manually wiped over a glass surface, an amount of the cleaning solution is dispensed from the substrate to disperse or dissolve the soil. The residue of solution on the glass dries to a clear, streak-free polymeric film.

The invention will be described by reference to the following detailed examples.

EXAMPLE I

A 500 ml beaker equipped with magnetic stirring was charged with 109.8 ml distilled water and 56.3 g of a solution prepared by solubilizing 0.14 g of powdered ethylenemaleic anhydride copolymer (EMA-31) in 27.7 ml water with 0.28 g of 28% ammonia, was added with agitation at 25° C. After 5.0 min., polyacrylamidomethylpropane sulfonic acid (2.0 g, HSP 1180, 17% aqueous solution) was added, and stirring continued until the reaction mixture cleared. Isopropyl alcohol (30.1 g) was added, and after 5.0 min. of stirring, 0.2 g of the anionic surfactant was added (Steol® CS-460, 60% actives). Stirring was continued until the reaction mixture cleared. Propylene glycol monomethyl ether (Arcosolv® PM, 0.5 g) was added, followed by 0.8 g of propylene glycol and 0.2 g of triethanol amine. The reaction mixture was stirred an additional 30 minutes at 25° C., resulting in 200 g of a clear solution.

The solution was loaded into a hand atomizer and employed to impregnate 0.64 $m^2$ nonwoven cellulosic sheets (Scott Paper Co., Philadelphia, Pa., Hi-Loft® 3030 wet laid paper) with 7.0 g of composition per sheet.

When an impregnated sheet was rubbed manually over a clean or soiled pane of glass, the residual film of cleaning solution dried evenly and rapidly, leaving a clear, non-sticky film which exhibited no visible streaking or cloudiness. The dirt and grease were effectively removed from the areas of the soiled glass which were treated.

The glass cleaning solutions of Examples II–V were prepared according to the procedure of Example I.

TABLE I

| Component | Weight Percent | | | | | |
|---|---|---|---|---|---|---|
| | II | III | IV | V | VI | VII |
| Distilled Water | 72.50 | 72.25 | 72.00 | 57.88 | 78.15 | 50.15 |
| Anionic Surfactant | 0.1* | 0.1* | 0.1+ | 0.1* | 0.1* | 0.1* |
| Polysulfonic Acid[1] | 0.6 | 0.6 | 0.6 | 1.0 | 1.0 | 1.0 |
| Isopropyl Alcohol | 10.0 | 10.0 | 10.0 | 12.0 | 15.0 | 15.0 |
| Polymer Solution[2] | 16.8 | 16.8 | 16.8 | 28.0 | — | 28.0 |
| Anhydride | — | — | — | — | 5.0 | 5.0 |

TABLE I-continued

| Component | Weight Percent | | | | | |
|---|---|---|---|---|---|---|
| | II | III | IV | V | VI | VII |
| Solution[3] | | | | | | |
| Solvent | — | 0.25# | 0.5** | 0.75** | 0.25** | 0.25** |
| Triethanol Amine | — | — | — | 0.15 | 0.1 | 0.1 |
| Propylene Glycol | — | — | — | 0.12 | 0.4 | 0.4 |

[1]HSP 1180 (17% actives),
[2]Solution of 0.5% EMA-31, 1.0% ammonia and 98.5% water,
[3]Solution of 9.1% phthalic anhydride, 9.1% ammonia and 81.8% water,
*Steol® CS-460,
2-Butoxyethanol, Dipropylene Glycol Monomethyl Ether, or Propylene Glycol Monomethyl Ether,
+Neodol® 25-3A or Petro® 22,
**Propylene Glycol Monomethyl Ether.

When 3030 sheets are impregnated with the solutions of Examples II–VII and evaluated as described for the Example I applicator, they perform satisfactorily in both the "clean" and "soiled" glass assays. The glass cleaning compositions of Examples VI and VII exhibited superior performance in terms of reduced friction when applied to glass surfaces in this manner.

While certain representative embodiments of the invention have been described herein for purposes of illustration, it will be apparent to those skilled in the art that modification therein may be made without departing from the spirit and scope of the invention.

What is claimed is:

1. A glass cleaning solution comprising:

(a) about 0.005–1% of a monomeric cyclic anhydride having a molecular weight of about 100–500;

(b) an amount of ammonia or an amine effective to solubilize said anhydride compound;

(c) about 0.025–0.5% of poly(2-acrylamido-2-methyl propane) sulfonic acid;

(d) an effective amount of an anionic surfactant;

(e) an effective grease-solubilizing amount of a ($C_1$–$C_4$)alkylene ($C_1$–$C_4$) alkyl ether or a ($C_1$–$C_4$) dialkylene ($C_1$–$C_4$)alkyl ether;

(f) about 5–25% of a ($C_1$–$C_4$) alkanol;

(g) the balance water.

2. The glass cleaning solution of claim 1 further comprising about 0.03–0.25% of a copolymer derived from (1) a maleic anhydride of the formula

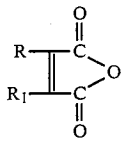

wherein R and $R_1$ are independently selected from the group consisting of H, ($C_1$–$C_4$) alkyl, phenyl, ($C_1$–$C_4$) alkylphenyl, phenyl ($C_1$–$C_4$) alkylene and (2) a ($C_1$–$C_4$) olefin.

3. The glass cleaning solution of claim 2 which comprises a mixture of about 0.05–0.175% of the copolymer and about 0.1–0.75% of the monomeric cyclic anhydride.

4. The glass cleaning solution of claim 1 wherein the monomeric cyclic anhydride is phthalic anhydride.

5. The glass cleaning solution of claim 1 wherein the copolymer is an ethylene-maleic anhydride copolymer.

6. The glass cleaning solution of claim 1 which has a pH of about 7.5–10.

7. The glass cleaning solution of claim 6 which comprises an amount of an alkanol amine effective to adjust the pH of the solution to about 8–9.75.

8. The glass cleaning solution of claim 7 which comprises about 0.05–0.75% of triethanol amine.

9. The glass cleaning solution of claim 1 wherein the ($C_1$–$C_4$)alkylene ($C_1$14 $C_4$)alkyl ether comprises propylene glycol monomethyl ether.

10. The glass cleaning solution of claim 1 which comprises an effective amount of a glycol plasticizer.

11. The glass cleaning solution of claim 10 which comprises about 0.1–1.0% of propylene glycol or ethylene glycol.

12. The glass cleaning solution of claim 1 which comprises about 0.1–1.0% of N-methyl-2-pyrrolidone 13. The glass cleaning solution of claim 1 wherein the anionic surfactant comprises a fatty alcohol-polyethylenoxysulfate salt.

14. The glass cleaning solution of claim 1 wherein the ($C_1$–$C_4$) lower alkanol comprises isopropanol.

15. A glass cleaning solution comprising:

(a) about 0.5–10% of an aqueous soltuion of about 5–15% phthalic anhydride and an amount of a basic compound effective to solubilize said copolymer;

(b) about 0.04–0.25% of poly(acrylamidomethyl-propane) sulfonic acid;

(c) about 0.01–0.3% of an anionic sulfonate or sulfate surfactant;

(d) about 0.05–1.0% of a ($C_1$–$C_4$) alkylene glycol ($C_1$–$C_4$)alkyl ether;

(e) 5–25% of a ($C_1$–$C_4$) lower alkanol; and (f) the balance water, wherein the pH of said glass cleaning solution is adjusted to about 8–9.5.

16. The glass cleaning solution of claim 15 wherein the pH of the solution is adjusted by the addition of about 0.05–0.75% triethanol amine.

17. The glass cleaning solution of claim 17 wherein the basic compound is ammonia.

18. An applicator for cleaning glass surfaces comprising a porous substrate impregnated with an effective amount of the glass cleaning solution of claims 1, 14 or 15.

19. The applicator of claim 18 wherein the porous substrate comprises a nonwoven cellulosic sheet.

20. A method for cleaning a soiled glass surface comprising applying the applicator of claim 18 thereto under conditions of pressure.

* * * * *